United States Patent [19]

Yamaoka et al.

[11] 4,043,542

[45] Aug. 23, 1977

[54] TUYERES FOR A BLAST FURNACE

[75] Inventors: Hiroshi Yamaoka, Hirakata; Morio Kawasaki, Nishinomiya; Hideyasu Kawanami, Wakayama; Toshihiro Shiino, Osaka; Junichi Yamashita, Wakayama, all of Japan

[73] Assignee: Sumitomo Metal Industries Limited, Osaka, Japan

[21] Appl. No.: 618,248

[22] Filed: Sept. 30, 1975

[51] Int. Cl.[2] ..... C21B 7/16

[52] U.S. Cl. ..... 266/270

[58] Field of Search ..... 266/270, 265; 427/192

[56] References Cited

U.S. PATENT DOCUMENTS

| | | | |
|---|---|---|---|
| 1,711,603 | 5/1929 | Lay | 427/192 |
| 3,096,160 | 7/1963 | Puyear | 427/253 X |
| 3,345,197 | 10/1967 | Martini et al. | 427/192 |
| 3,831,918 | 8/1974 | Mori et al. | 266/270 |

FOREIGN PATENT DOCUMENTS

| | | | |
|---|---|---|---|
| 235,238 | 11/1959 | Australia | 266/270 |
| 235,316 | 6/1925 | United Kingdom | 266/270 |
| 474,064 | 1/1936 | United Kingdom | 427/192 |
| 162,173 | 4/1964 | U.S.S.R. | 266/270 |
| 293,852 | 3/1971 | U.S.S.R. | 266/265 |

OTHER PUBLICATIONS

Metalcasting Dictionary, 1st edition, 1968, p. 34.

*Primary Examiner*—Gerald A. Dost

*Attorney, Agent, or Firm*—Watson, Cole, Grindle & Watson

[57] ABSTRACT

Tuyeres for a blast furnace are disclosed wherein a coating is formed on the inner and outer peripherential surfaces of the tuyere body by subjecting the surfaces to a calorizing treatment to diffuse a diffusion agent comprising a powdery mixture of alumina and aluminum at a treating temperature of about 800° C. The tuyere body is shaped so as to form an inner jacket, and the walls of the tuyere body forming the inner jacket may also be subjected to a calorizing treatment.

7 Claims, 2 Drawing Figures

TUYERES FOR A BLAST FURNACE

The present invention relates to an improvement in tuyeres used for blasting an oxidizing gas into a blast furnace. It is directed to preventing loss or damage to the tuyeres caused by fusion thereof, and achieves an increase in the life or the tuyeres and prevents any decrease in the blast gas temperature.

Tuyeres have been previously constructed from pure copper castings, and prevention of fusion loss of the tuyeres during operation has been achieved by flowing cooling water through inner jacket thereof. However, much fusion loss has occurred by the direct contact of the molten iron and slag in the furnace with the inner and outer surfaces of the tuyere body. In addition, due to the high flow rate of the cooling water through the inner jacket, the high temperature blast gas has been reduced in temperature from by 50° to 60° C (from a maximum of 1200° to 1250° C), and the tuyeres have been worn down by the action of the cooling water (or contaminates in the water), resulting in a decrease in the thickness of the tuyeres and often a breaking down of the tuyeres. Thus, since current operational conditions have required an increased flow rate of the blast gas, and very high temperature blast tubes and tuyeres i.e., in order to increase the production rate of molten iron, the chance of breaking down of the tuyeres has increased. In order to prevent fusion loss on the surface contacting the molten slag and the like, cooling with water of a high flow velocity has been required in order to increase the cooling capability of the cooling water. Consequently, wear on the surfaces in the inner jacket has frequently occurred and concurrent disadvantages, such as an decrease in the blast gas temperature and the like, have been introduced.

It is thus an object of the present invention to provide tuyeres for blasting an oxidizing gas into a blast furnace which have been subjected on their inner and outer peripherential surfaces to a calorizing treatment to eliminate such disadvantages. The invention also involves similarly treating the internal surface of the tuyere which forms the inner jacket.

DESCRIPTION OF THE DRAWING

In FIG. 1, there is illustrated a tuyere body 1 which has internal surfaces which form a cooling jacket 8, which has had its inner and outer peripherential surfaces 2 and 3 subjected to a calorizing treatment so as to form coating layers 4 by diffusing a powdery mixture of alumina and aluminum at a temperature of about 800° C. The blasting tuyere is attached to the furnace wall 6 by means of a tuyere housing 5. The blast gas is fed from a hot-stove furnace into the blast furnace in the direction of arrow A through a nozzle 7. A cooling liquid is introduced into the jacket 8 from the direction of arrow B and discharged therefrom in the direction of arrow C.

Figure 1:
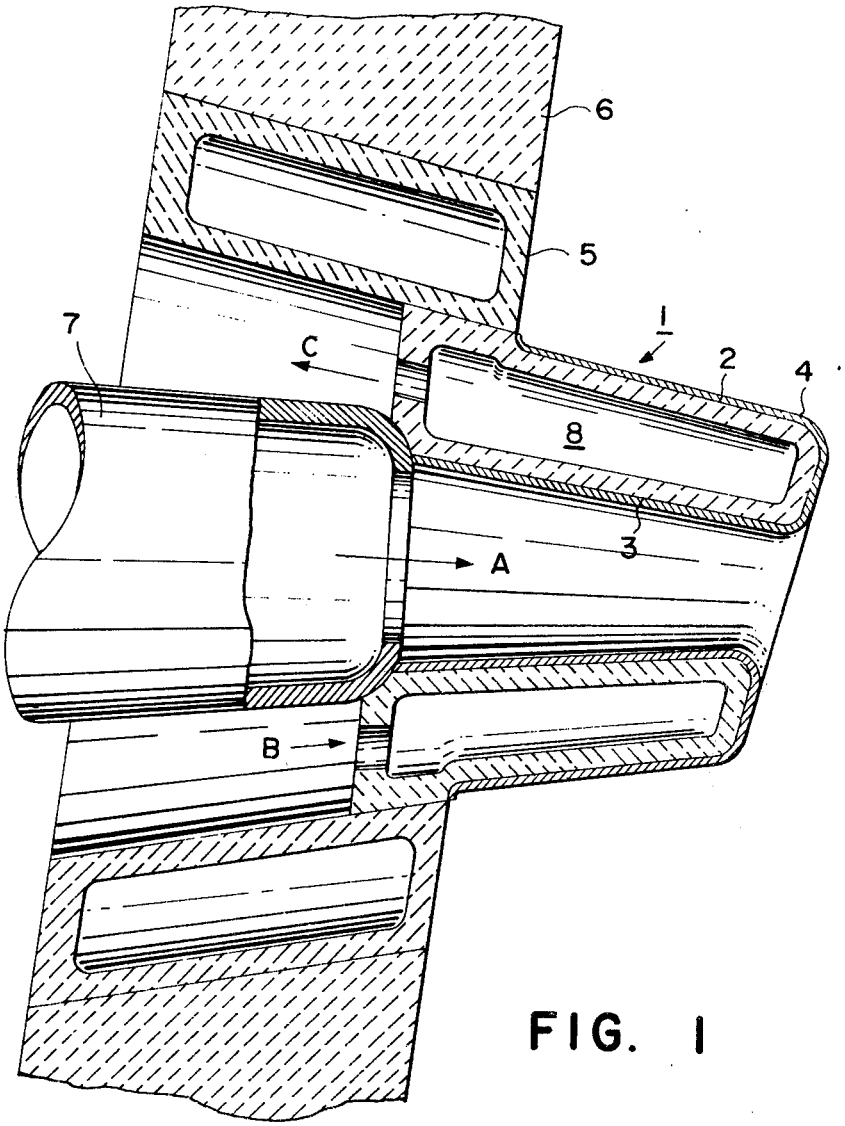
FIG. 1 illustrates a sectional view through the center line of an embodiment of the blasting of the blasting tuyeres according to the present invention.
Figure 2:
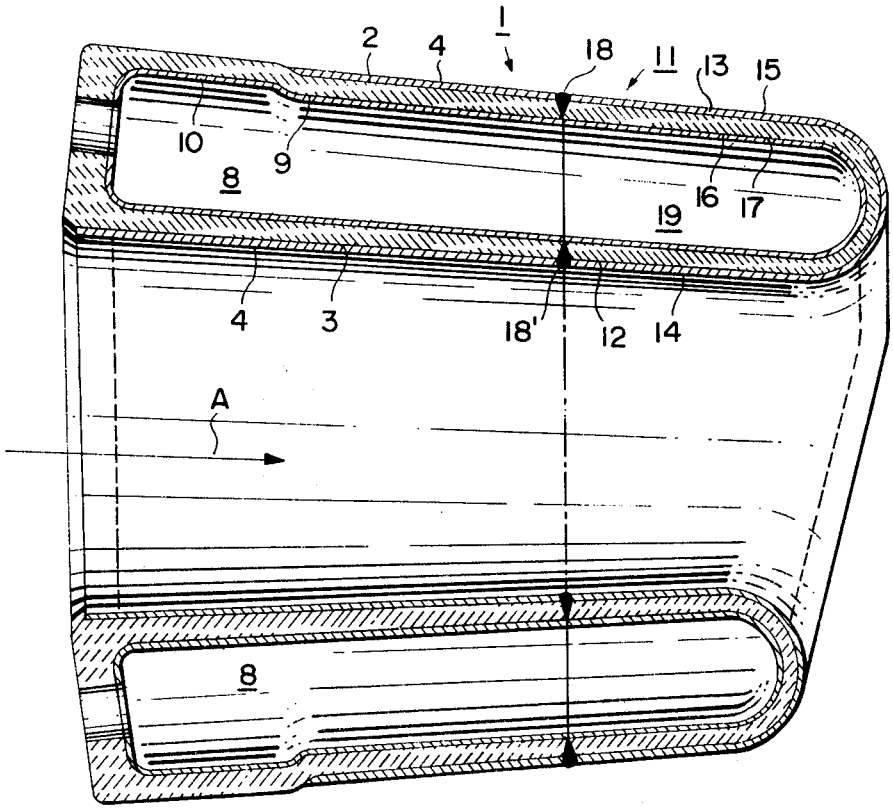
FIG. 2 illustrates a similar view of another embodiment.

In another embodiment as shown in FIG. 2, the tuyere body 1 has been subjected to a calorizing on not only the inner and outer peripherential surfaces in a similar manner to that in FIG. 1, but also the inner surfaces 9 which form the jacket 8 have been treated to form a calorized coating 10. A tuyere nose 11 is attached to the tuyere body 1. The coating 14, 15 have been applied on the inner and outer peripherential surfaces 12 and 13 by subjecting them to calorizing. A coating 17 has also been applied to the inner surface 16 forming the jacket 19 by calorizing. Then the tuyere body 1 is connected integrally to the tuyere nose 11 by means of copper welding 18, 18' or the like. When the thickness the calorized coating ranges from 0.5 to 5 mm on the inner and outer surfaces of the tuyere and from 0.1 to 1 mm on the inner surface of the jacket, a decrease in the thermal conductivity of the copper body and nose is insignificant and a good cooling effect can be achieved in the tuyere.

As set forth hereinbefore, the present invention comprises subjecting the inner and outer peripherential surfaces of the tuyere and internal surfaces which form the jacket to a calorizing so that the fusion loss of the tuyeres by the direct contact of molten iron, slag and the like is reduced and damage due to cooling water and contaminates therein are also reduced. Moreover, the apparent blast temperature can be increased by an level ranging from 30° to 40° C and the coke ratio can be reduced by an extent ranging from 6 to 7 kgs/ton. In addition, since the calorizing according to the present invention is effected by diffusing and penetrating a diffusion agent such as aluminum oxide from the surfaces into the inner portions, no possibility of peeling off of the coating is encountered.

What we claim is:

1. A tuyere structure for blasting a gas into a blast furnace wherein said tuyere is composed of copper and wherein the inner and outer peripherential surfaces of said copper tuyere include a calorized coating of alumina and aluminum in a thickness ranging from 0.5 to 5 mm directly contacting said surfaces of said copper tuyere.

2. A tuyere according to claim 1 wherein said tuyere includes a body portion and a nose portion which are connected with a copper welding.

3. A tuyere according to claim 1 wherein said tuyere has internal surfaces forming a jacket for cooling water and wherein said internal surfaces are also calorized.

4. A tuyere according to claim 3 wherein the internal surfaces contain alumina and aluminum diffused therein.

5. A tuyere according to claim 1 wherein said inner and outer peripherential surfaces contain alumina and aluminum diffused therein.

6. A tuyere according to claim 3 wherein said internal surfaces have a coating of alumina and aluminum thereon of a thickness ranging from 0.1 to 1.0 mm.

7. A tuyere according to claim 1 wherein said surfaces are calorized at about 800° C.

* * * * *